US006109182A

United States Patent [19]

Vestman et al.

[11] Patent Number: 6,109,182

[45] **Date of Patent: *Aug. 29, 2000**

[54] PROCEDURE FOR FULLY AUTOMATIC CYLINDER CLEANING IN PRINTING PRESSES HAVING A CENTRAL CONTROL SYSTEM

[75] Inventors: Rune G. Vestman; Kjell E. Lundin, both of Zwingenberg, Germany

[73] Assignee: Oxy-Dry Maschinen GmbH, Egelsbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/988,040

[22] Filed: Dec. 10, 1997

Related U.S. Application Data

[63] Continuation of application No. 08/340,376, Nov. 14, 1994, abandoned.

[30] Foreign Application Priority Data

Nov. 12, 1993 [DE] Germany ..... 43 38 625

[51] Int. Cl.[7] ..... B41C 33/00

[52] U.S. Cl. ..... 101/483; 101/424

[58] Field of Search ..... 101/483, 424, 101/423, 425

[56] References Cited

U.S. PATENT DOCUMENTS

| | | | |
|---|---|---|---|
| 4,656,941 | 4/1987 | Brouman | 101/483 |
| 4,686,902 | 8/1987 | Allain et al. | 101/424 |
| 4,967,664 | 11/1990 | Iijima | 101/423 |
| 5,097,764 | 3/1992 | Waizmann | 101/425 |
| 5,109,770 | 5/1992 | Uribe et al. | 101/424 |
| 5,170,711 | 12/1992 | Maier et al. | 101/483 |
| 5,174,209 | 12/1992 | Rodi et al. | 101/424 |
| 5,309,836 | 5/1994 | Takeuchi | 101/425 |
| 5,584,245 | 12/1996 | Schonberg | 101/425 |
| 5,740,030 | 4/1998 | Ottl et al. | 101/425 |

FOREIGN PATENT DOCUMENTS

| | | |
|---|---|---|
| 0 423 093 A2 | 4/1991 | European Pat. Off. . |
| 0 570 676 A1 | 11/1993 | European Pat. Off. . |
| 3723400 C1 | 2/1989 | Germany . |
| 9300703 U1 | 4/1993 | Germany . |
| 62-90132 | 6/1987 | Japan . |
| 62-149449 | 7/1987 | Japan . |
| 1-204740 | 8/1989 | Japan . |
| 4-41241 | 2/1992 | Japan . |
| 2 267 868 | 12/1993 | United Kingdom . |

OTHER PUBLICATIONS

"Bal–kleen, Gummituch–Waschanlage B 300 Fur Bogenoffsetmaschinen", *Baldwin*(with complete translation).

*Primary Examiner*—John S. Hilten
*Assistant Examiner*—Anthony H. Nguyen
*Attorney, Agent, or Firm*—Staas & Halsey LLP

[57] ABSTRACT

A procedure for fully automatic cleaning of cylinders in printing presses that are fitted with a central control system and automated wash devices, with an expansion of the central control system, by means of which the operating parameters for determining the optimal wash sequence programs for each individual wash device are determined by accessing the central printing press control system, the optimal wash sequence programs for each individual wash device are determined automatically, and the individual wash devices are controlled in each instance by the appropriate optimal wash sequence program.

22 Claims, 5 Drawing Sheets

PROCEDURE FOR FULLY AUTOMATIC CYLINDER CLEANING IN PRINTING PRESSES HAVING A CENTRAL CONTROL SYSTEM

This application is a Continuation of application Ser. No. 08/340,376, filed Nov. 14, 1994 now abandoned.

BACKGROUND OF THE INVENTION

1. Field of the Invention

The present invention relates to a procedure for fully automatic cylinder cleaning in printing machines with a central control system.

2. Background of the Related Art

Printing machines are taken to be newspaper rotary presses, jobbing rotary presses and sheet-fed printing presses, for all printing processes, such as offset printing, Anilox offset, intaglio printing, flexographic printing, Anilox-flexographic printing, relief printing, and photogravure printing. The cylinders to be cleaned are understood to be all of the rollers, rolls, and cylinders, in particular rubber-blanket [offset] cylinders, inking cylinders, plate cylinders, cooling rollers, guide rollers, ink rollers, and damping rollers.

Common to all of these presses is the fact that intensive contact is required between the material to be imprinted and the cylinders in order to guide, process, and drive sheets or webs that are to be imprinted. Because of this, deposits of paper dust, printing ink, and sometimes powder dust build up on the cylinders. These deposits prevent the cylinders from functioning correctly; for example, deposits on rubber-blanket cylinders have a deleterious effect during offset printing: the sharpness of the images is lost and some areas of print are not correctly printed. However, the rate at which such deposits accumulate on rubber-blanket cylinders is particularly high because of high viscosity and the adhesive properties of the printing ink. Thus, for reasons of operating safety, and to maintain print quality, it is essential that dirt and the like is removed from such cylinders on a regular basis.

As a rule, when such deposits are to be removed, the printing process is interrupted and the cylinders are washed by hand. This requires not only a great deal of time—the washing procedure and the interruption of the printing process take about fifteen minutes—but the personnel performing the washing procedure have to proceed with caution in order that no lint from the cleaning rags remain behind on the surface, particularly of rubber-blanket cylinders, for such lint cause foul impressions. In addition, such hand washing is a health hazard for the personnel who perform the washing process, for contact with solvents dissolves the protective covering on the skin and breathing high concentrations of solvent vapours is prejudicial to general health.

Automated printing cylinder washing devices, such as described in EP 0 419 289 A2, have been used of late.

Essentially, the automated washing device described in the above-quoted document comprises a roller brush that can be moved against the cylinder that is to be cleaned, nozzle tubes for spraying the roller brush with washing fluid, feed lines for the washing fluids, and a control system to manage the individual functions. If a plurality of washing devices are used in a printing press, they can be controlled from a central control unit, and this makes it possible to operate such devices by remote control.

The great disadvantage of these known, automated printing cylinder washing devices is the fact that the wash programs cannot be varied. For example, with respect to the individual washing devices, the duration of the cleaning process, the metering of washing liquids, and—above all else—the timing of the washing liquid metering, and the mechanical course of the cleaning process are fixed for the cleaning conditions that are, as a rule, to be expected.

Various operating parameters, for example, the speed at which the cylinders are rotated during the cleaning process, or information as to whether or not there is contact between the cylinder and the material to be imprinted and whether or not this contact is with the face or the reverse side of the material to be imprinted, the volume of production since the last washing, the position of the cylinders in the printing sequence, or the quality of the paper naturally have a great effect on the length of the washing process that will be required, the quantity of liquid required, and, above all else, on the precise sequence followed during the duration of the washing process. If the cylinders are soiled too heavily, or the pre-set wash programs are not designed for the existing operating parameters, the results obtained from the washing process will be unsatisfactory and will lead to poor quality printing when printing operations are resumed, or else the washing procedure will have to be repeated. In addition, in the case of rotary printing presses with a web of material to be imprinted, unsatisfactory results from the washing process can result in the web tearing. It is just as inappropriate if the degree of soiling of the cylinder is less than expected, for the cylinder will become too wet in the course of the cleaning procedure, so that when printing is resumed, there will be a great deal of waste. In the case of web-type printing presses, it can even happen that if it is dampened too much, the web will break. However, the web must at all costs be prevented from tearing, for if it does, the web will have to be re-threaded [relaced], and this generally takes about 20 minutes.

Especially in the case of large printing presses, which incorporate a plurality of printing units and other cylinders, and in the case of web-type printing presses that permit a large number of variations, for example, in the routing of the web, ink application, or cylinder adjustment, it is difficult to see which cylinders have to be cleaned with a particular washing program. In such cases, up to now it has been almost unavoidable that the cylinders are frequently cleaned when there is no need for it, or that additional personnel are required to identify the need for cleaning by way of visual inspection.

SUMMARY OF THE INVENTION

Proceeding from this prior art, it is the task of the present invention to describe a procedure for fully automatic cylinder cleaning in a printing press with a central control system, with which it is possible to achieve optimal cleanliness for the minimum consumption of washing liquids, with minimal outlay, by means of automated washing devices on each of the cylinders that is to be cleaned, and to do this in the shortest possible time, and at the same time avoid tearing a web of material that is to be imprinted.

This problem has been solved by an expansion of the control system, by means of which the operating parameters used for determining the optimal wash program for each individual wash device can, in each instance, be identified by accessing the central printing press control system, which automatically identifies the optimal wash program for each individual wash device, and by which the individual wash devices are controlled in the optimal manner by the appropriate optimal wash program.

According to the present invention, it is also known that each individual cylinder that is to be cleaned, as well as the special cleaning conditions at this cylinder, are identified per se and that a wash program that has been compiled individually has to be set up and run in order to achieve optimal results from the wash program. The risks of lack of cleanliness, over-dampening, or of the web tearing is too high in the case of pre-set average wash programs.

Compared to manual cleaning of the cylinders, the procedure according to the present invention is significantly faster, safer, and more cost-effective, as is made perfectly clear.

Particular advantages result if wash sequence central computer is used as an addition to the central printing press control system. This central computer can communicate, on a selective basis, with the various levels of the printing press control system and so access the information that is needed to determine the optimal wash sequence program. The identification of the optimal wash sequence programs and the control of the individual wash devices is then managed from this central computer.

For reasons of simplification, determination of the optimal wash sequence program can, in each particular instance, be effected by selecting the closest approximation from a number of fixed, pre-set sets of wash sequence programs, although it is also possible that the wash sequence programs can be determined by the computer by way of an algorithm, using operating parameters that have been captured, either individually or in groups.

The speed of rotation during the washing process has a great effect on the parameters of the optimal wash sequence program that is to be selected. For this reason, it is advantageous that this speed of rotation be considered when determining the wash sequence program.

The volume of printing performed by the printing press prior to the starting time of the washing procedure is also responsible for the degree to which the cylinder that is to be cleaned has become soiled, and it is useful to consider this, too, when determining the optimal wash sequence program.

According to one preferred embodiment of the procedure according to the present invention, contact between the material to be imprinted and the cylinder during the cleaning procedure is taken into account as an operating parameter when determining the optimal wash sequence program; when this is done, it can be an advantage to take into account information as to whether it is the face or the back of the web that is touching the cylinder. The surface characteristics of the web of paper are, of course, important with respect to the rate at which the cylinder that is to be cleaned will become soiled.

It is also important to take into account the type of paper, possibly categorised by manufacturer, and the ink type as operating parameters when determining the wash sequence program; both operating parameters have a significant effect on the rate of soiling and the degree of difficulty associated with removing the soil. In the case of paper type, for instance, pulverulence and pick resistance are considered, as is the paper's compatibility with the wash liquid and, in particular, water; in the case the printing ink, tack and the ease with which it can be washed off are considered.

The position of the cylinder in the printing sequence can also be considered as an operating parameter when determining the wash sequence program. This is useful, for example, when paper is the material that is to be imprinted, for experience has shown that it is on first contact between the paper and the cylinder that the greatest quantity of paper fibres are picked and these then accumulate on the cylinders. However, it is the fact as to whether printed or unprinted imprint material comes into contact with the cylinders that is important for the type and amount of soiling.

It is preferred that the direction of rotation of the cylinder during the wash process be taken into account as an operating parameter when determining the optimal wash sequence program. Because of the fact that the automated wash devices do not generally operate symmetrically with respect to the direction of rotation of the cylinder that is to be cleaned, the direction of rotation of the cylinder during the wash process will affect the results obtained by the washing. For this reason, it is an advantage to take this operating parameters into account during the wash sequence program.

In the case of web-type printing presses, there are additional advantages if the angle of wrap of the web of material that is to be imprinted around the cylinder that is to be cleaned during the wash process is taken into account as one of the operating parameters for determining the optimal wash sequence program; the angle of wrap of the material that is to be imprinted has a major influence on the quantity of liquid that is lifted from the cylinder that is to be cleaned by the web, and then carried away. This, in turn, is decisive with respect to the web tearing. On the other hand, the web, with the cleaning liquid, carries part of the soil away, and this has a positive effect on the results obtained by the wash process. Finally, both these effects have an effect on the quantity of liquid that remains on the cylinder, and thus, very possibly, they have an indirect effect on the amount of waste that is created when printing is resumed. The angle of wrap of the material that is to be imprinted around the individual cylinder is determined by the routing of the web and the position of the cylinder in the printing unit, so that determination of the "angle of wrap-around" operating parameter can be determined by accessing data relating to the routing of the web and the press position.

However, in order to determine the optimal wash sequence program, it is in most instances sufficient if ranges of the paper web wrap around angles alone are identified; this can be done such that three paper web wrap around angle ranges are identified, namely: a) 0 degrees; b) up to approximately 5 degrees; and c) more that 5 degrees.

Preferably, the quantity of dampening water that is used is also determined and used as an operating parameter in order to determine the wash sequence programs. The quantity of dampening water that is used has a major effect on the build up of deposits on the cylinders.

Particular advantages ensue if the correct time for starting each wash procedure is determined and thereafter each wash procedure is started automatically at this precise time or at the next possible opportunity. Thus, it is even possible to clean each individual cylinder that is to be cleaned at individual wash intervals or else, at the next opportunity, to clean all cylinders or individual groups of cylinders. Under some circumstances, it can also be proper to clean one or more of the cylinders "prematurely"; the proper time for cleaning will result in each instance by taking into account all the relevant operating parameters that have to be exploited in order to determine not only the degree of soiling, but also, for example, breaks in production that are made necessary by the production sequence.

More expediently, the wash sequence programs that are determined by the printing press control system can be checked and corrected manually from a central control position, for example.

In the case of a rubber-blanket cylinder, information as to whether or not this cylinder was involved in ink distribution during the printing process can also be used to advantage as an additional operating parameter when setting up the wash sequence program. It is perfectly clear that the rate at which this rubber-blanket cylinder becomes soiled will depend to a significant degree on whether or not it was used for printing.

Finally, information as to whether the cylinder that is to be cleaned has come into contact with printed or unprinted material that is to be imprinted can be taken into consideration as an operating parameter when setting up the wash sequence program.

As a result of the procedure according to the present invention, determination of the operating parameters for identifying the optimal wash sequence programs for each individual wash device is effected at a point at which all process parameter data, be it in the form of a default value or as feedback from the press, are already available in ordered form. An operator who controls the overall printing press, for example by way of a central control post, need no longer be concerned about the wash sequence programs; they will be determined automatically, whereupon the individual wash sequence programs can be initiated automatically as well.

Particular advantages result in the case of web-type printing presses with guide rollers, between which the material to be imprinted passes first after the rubber-blanket roller, it is a great advantage if these do not have to be provided with their own automated wash devices or wash agent applicators, optionally, with in each instance one for each side of the web of material that is to be imprinted. Because of the access to the central printing press control system, as in the present invention, it is possible to select the last automated wash device before the guide rollers—as viewed in the direction of movement of the web of material that is to be imprinted, and with which a cylinder that is in contact with the web of material to be imprinted is associated—can be selected; optionally, an automated wash device that is the last one, as viewed in the direction of movement of the web of material that is to be imprinted, that is before the guide rollers, can be selected for each of the two sides of the web of material that is to be imprinted. A wash sequence program with which the automated wash device is controlled is then made up for this selected, automated wash device, and this same program then dampens the web of material that is to be imprinted with cleaning liquid, by simultaneously taking into account the actual cleaning requirement that has similarly been determined by accessing the central printing press control system. The web of material that is to be imprinted runs from the rubber-blanket cylinder with which the selected, automated wash device is associated, to the guide rollers that are to be cleaned. According to the present invention, during the time they are in contact with the web of material that is to be imprinted and which has been dampened, the guide rollers that are to be cleaned are braked or driven, under control, either manually or without further instructions, from the central control post, so as to generate slippage between the guide rollers and the web of material that is to be imprinted. If the slippage procedure is automated, the time and the duration of the slippage sequences of the individual guide rollers is determined automatically by accessing the data that is available in the in the central control system, and then using it to optimize the total procedure (washing all the guide rollers). Because of the slippage, and because of the fact that the web of material that is to be imprinted has been dampened with cleaning liquid as required, the desired cleaning effect for all the guide rollers that are to be cleaned will be achieved. By so doing, within the framework of the present invention and without additional outlay, at least some of the guide rollers can be cleaned automatically, without having to associate an automated wash device or a wash agent applicator for each web of material that is to be imprinted, or, optionally, to associate one with each side of the web, with the guide rollers. When this is done, the application system for the wash agent can be arranged either ahead of or after the rubber-blanket wash apparatus.

BRIEF DESCRIPTION OF THE DRAWINGS

The examples that follow disclose additional features and special characteristics of the present invention, and these are described on the basis of the drawings appended hereto. These drawings show the following.

DETAILED DESCRIPTION OF THE PREFERRED EMBODIMENTS

Figure 1:
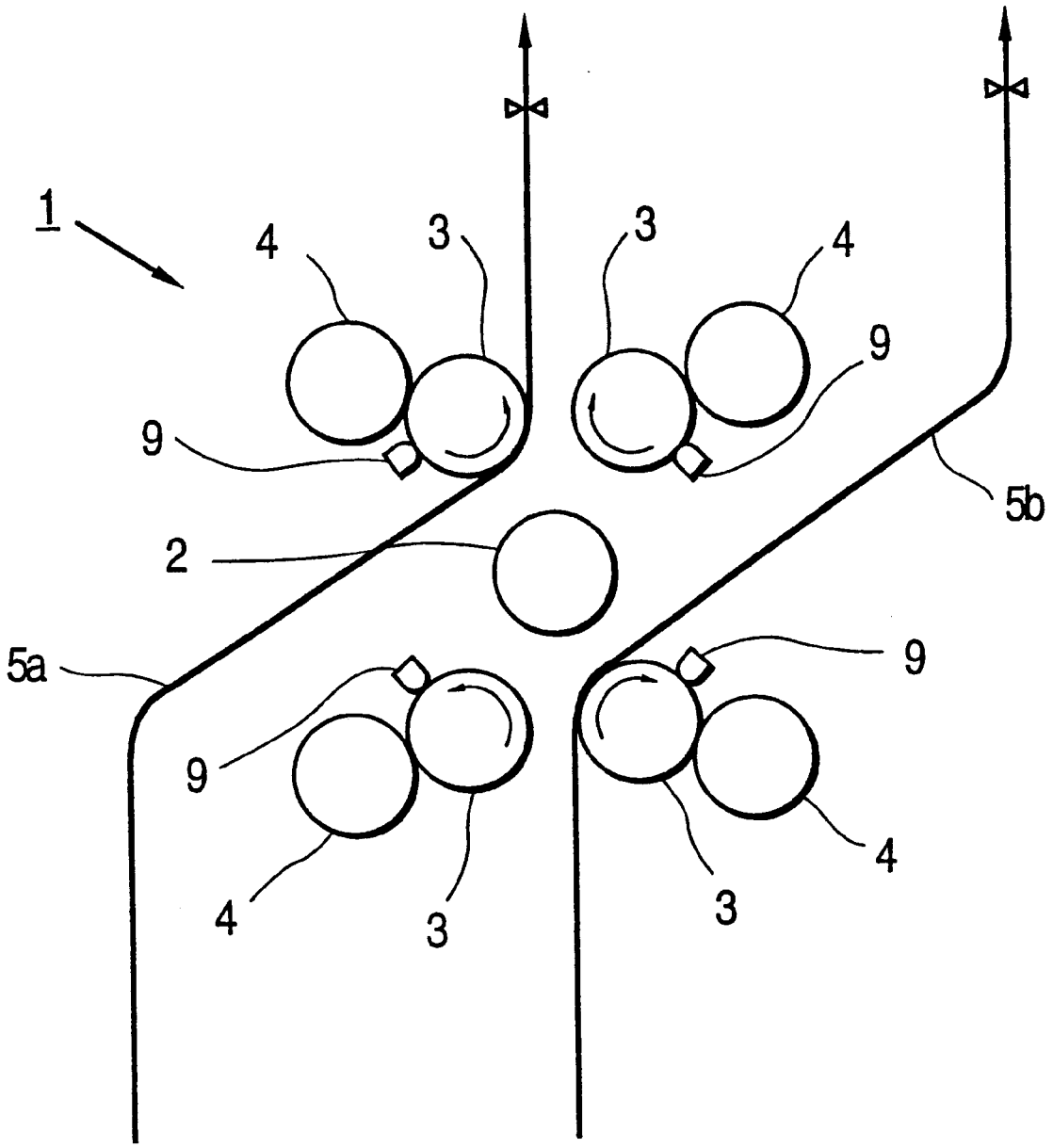
FIG. 1: A schematic drawing of a satellite unit of a newspaper rotary printing press.

FIG. 1 shows a satellite unit of a newspaper rotary offset press in which two webs of paper, 5*a* and 5*b,* are to be imprinted in 1+1 print.

The satellite unit 1 is in the print off position. Essentially, this comprises an impression cylinder 2, four rubber-blanket cylinders 3, and four printing plate cylinders 4. In the example that is shown, in the print on position, the webs of paper 5*a* and 5*b* are each imprinted between two rubber-blanket cylinders 3 without contact with the impression roller 2. The rubber-blanket cylinders 3 are now cleaned in the print off position by wash devices 9 that are associated with each rubber-blanket cylinder 3. It is now clear, that the wash devices 9 are each operating under different parameters, which means that the wash sequence programs for the wash devices 9 must be different in order to achieve optimal results: two of the four rubber-blanket cylinders 3 are in contact with the paper during the cleaning process, and so there is a risk of the web tearing, so that in this case, cleaning conditions are completely different from those that apply to the other two rubber-blanket cylinders 3. The operating conditions that are important in this instance are, for example, contact between the web of paper and the cylinder, the angle of wrap, rubber-rubber printing instead of rubber-steel printing, peripher speed of the rubber-blanket cylinders 3, and the quantities of ink and dampening water involved. The operating parameters such as the type and quality of the paper web, and link, and also information as to whether the cleaning is carried out during or after the production run, must also be considered. In addition, the direction of rotation of the rubber-blanket cylinders 3 is not uniform during the cleaning process. In this example, the procedure according to the present invention makes it possible to set up the individual wash sequence programs for the individual wash devices 9 in an optimal manner, which means that the individual wash devices 9 can be optimally controlled by way of individually matched wash parameters such as quantity of washing agent, quantity of water, intensity and overall duration of the mechanical cleaning process, but above all, with the individually matched timing of these wash parameters.

Figure 2:
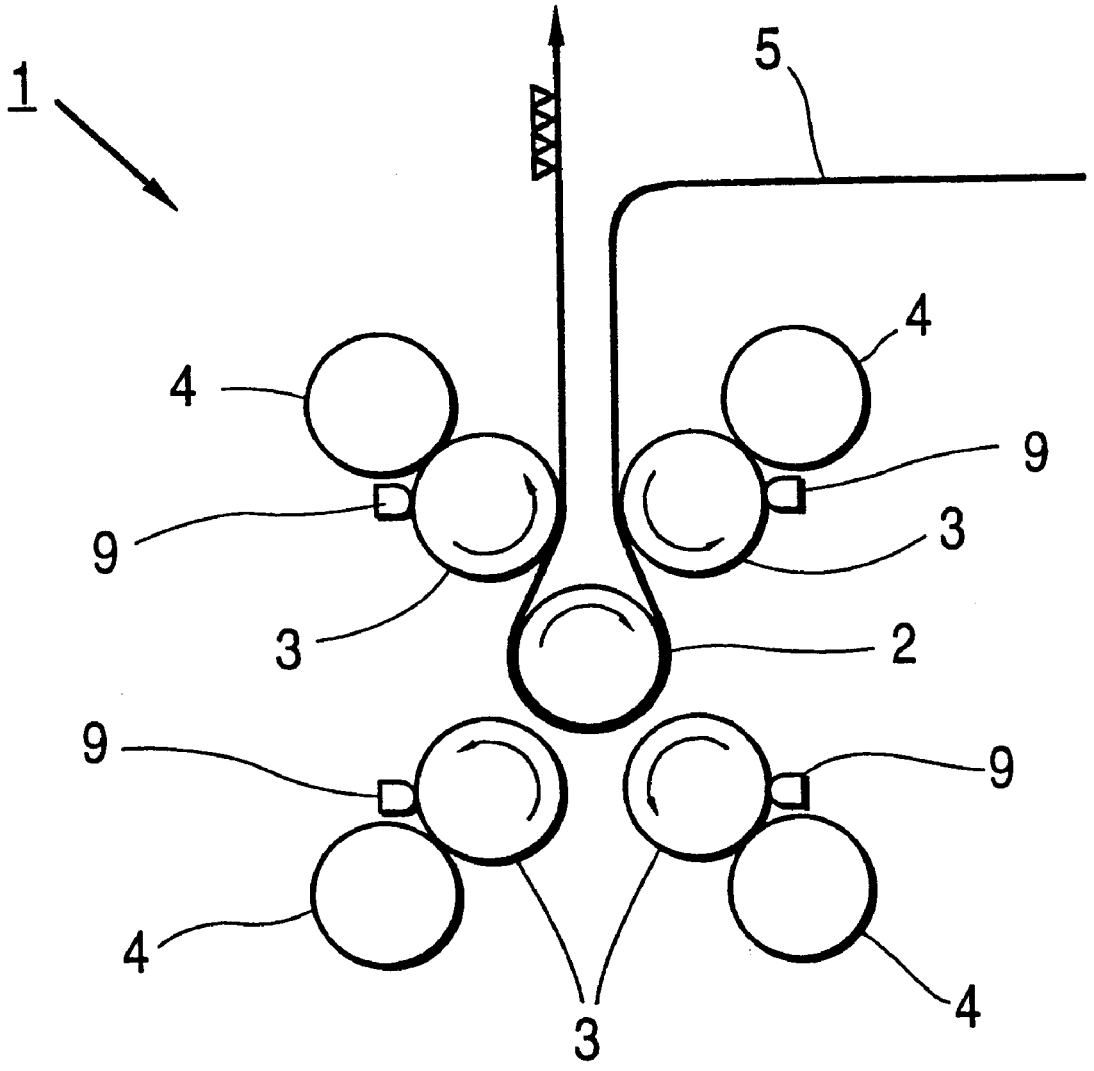
FIG. 2: A schematic drawing of another satellite unit of a newspaper rotary printing press.

FIG. 2 shows the same satellite unit of a newspaper rotary offset printing press with another routing of the web. In this, the web of paper 5 is imprinted in the 4+0 print. Here, too, it is once again clear that two of the four rubber-blanket cylinders 3 are in contact with the paper during the cleaning procedure, and the remaining two rubber-blanket cylinders 3 are not in contact with it. In this example, in the print on position, the web of paper 5 is imprinted between the inking roller 2 and the four rubber-blanket cylinders 3; it is thus printed between rubber and steel. In this instance, the printing plate cylinder 4 and the wash devices 9 carry out the same function as in satellite unit 1 in FIG. 1. Here, too, essentially the same parameters are of interest with respect to determining the optimal wash sequence programs, although it is clear that the operating parameters and thus the optimal wash sequence programs for the wash devices 9 differ from the operating parameters that apply to the example shown in FIG. 1.

Within a satellite unit 1, there are not only different operating parameters for the individual cylinders that are to be cleaned during one and the same production run; two production runs that follow in sequence, with, for example, different web routings, can sometimes greatly modify the operating parameters for the cylinders of the same satellite unit 1 that are to be cleaned.

Figure 3A:
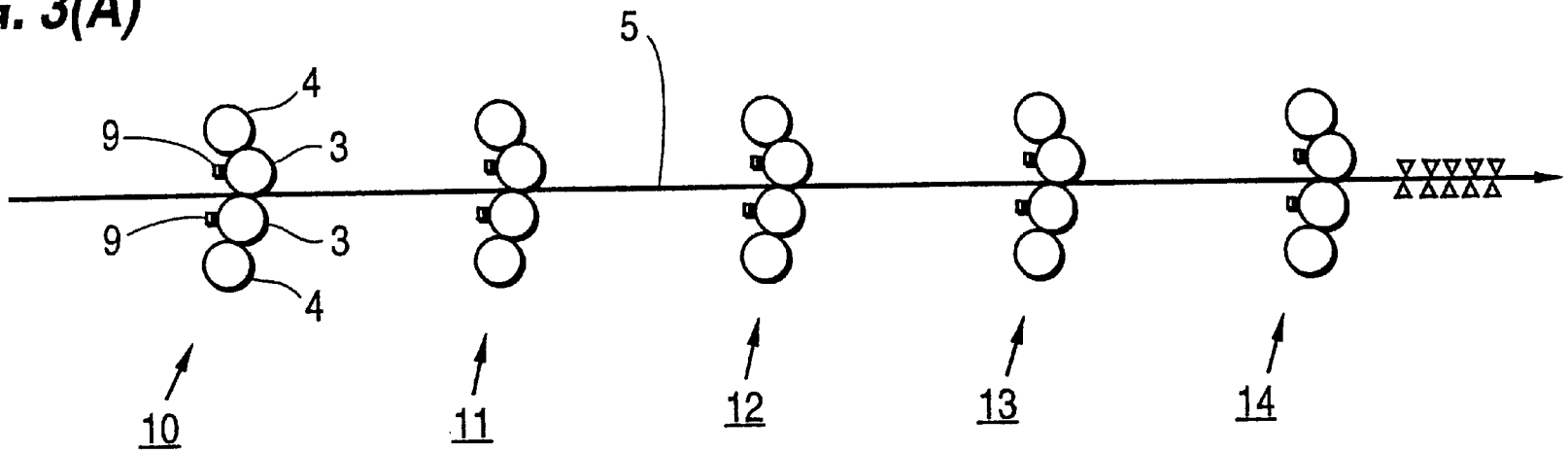
FIGS. 3(A) and (B): Schematic drawing of a rotary jobbing printing press.
Figure 3B:
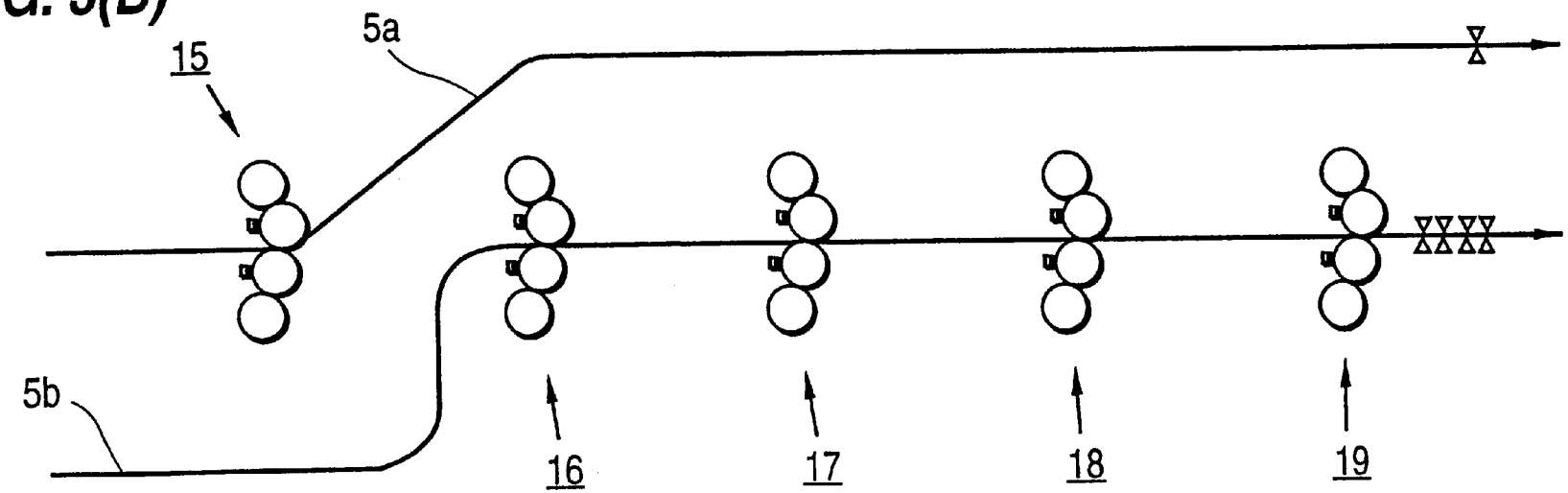

FIGS. 3(A) and (B) show two possible web routings in a jobbing rotary printing press. In the upper diagram (FIG. 3(A)), a paper web 5 is imprinted in the 5+5 print and passes through the printing units 10, 11, 12, 13, and 14 in a straight line. Essentially, these printing units each comprise two rubber-blanket cylinders 3 and two printing plate cylinders 4, with a wash unit 9 being associated with each of the rubber-blanket cylinders 3. The lower diagram (FIG. 3(B)) shows that two webs of paper 5*a* and 5*b* can pass through, as selected. The paper web 5*a* is thus imprinted with a 1+1 print in printing unit 15, the paper web 5*b* receives a 4+4 print in the printing units 16, 17, 18, and 19. As can be seen, in FIGS. 3(A) and (B), the operating parameter that is of the greatest interest is the sequence of print units: print unit 10 is the first to come into contact with the paper web 5, which means that it is at this point that an above-average number of paper fibres will be picked off the fresh web of paper 5. Print unit 11, which is in the second position, comes into contact with freshly imprinted paper. Things are different with respect to print units 15 and 16, each of which is in the first position. For this reason, the wash sequence program for the wash devices 9 in the print units 11 and 16 have to be different. In a jobbing rotary printing press, it is also the norm to operate with various paper types and printing inks, which means that paper quality and ink quality are the most important operating parameters for determining each optimal wash sequence program.

Figure 4A:
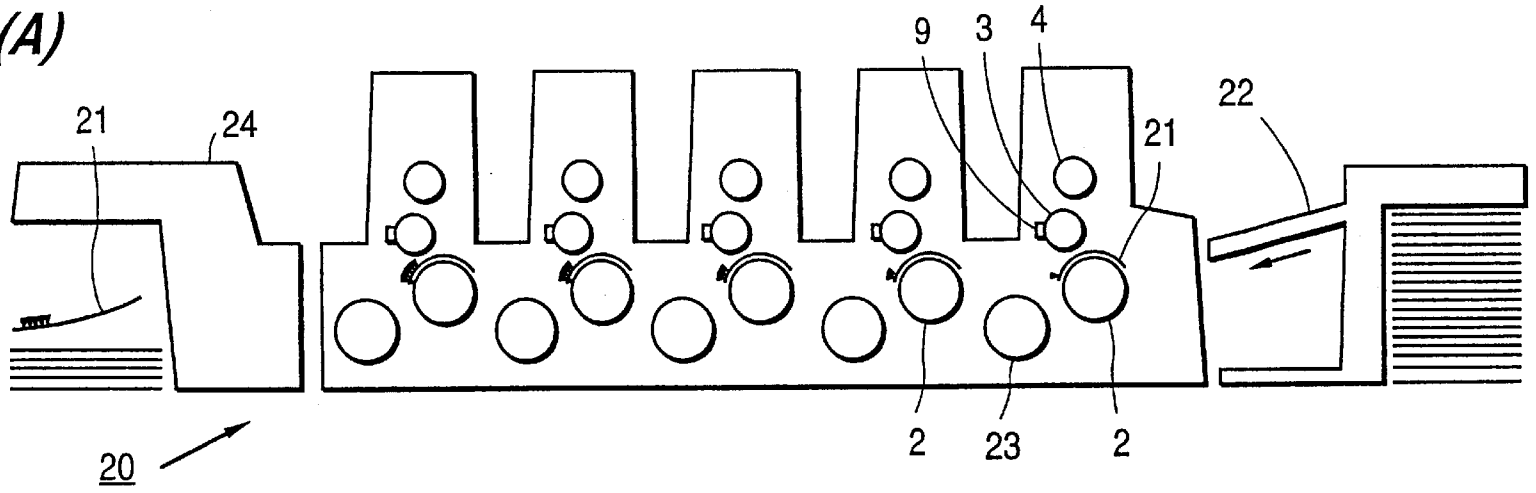
FIGS. 4(A) and (B): Schematic drawing of a sheet-fed printing press.
Figure 4B:
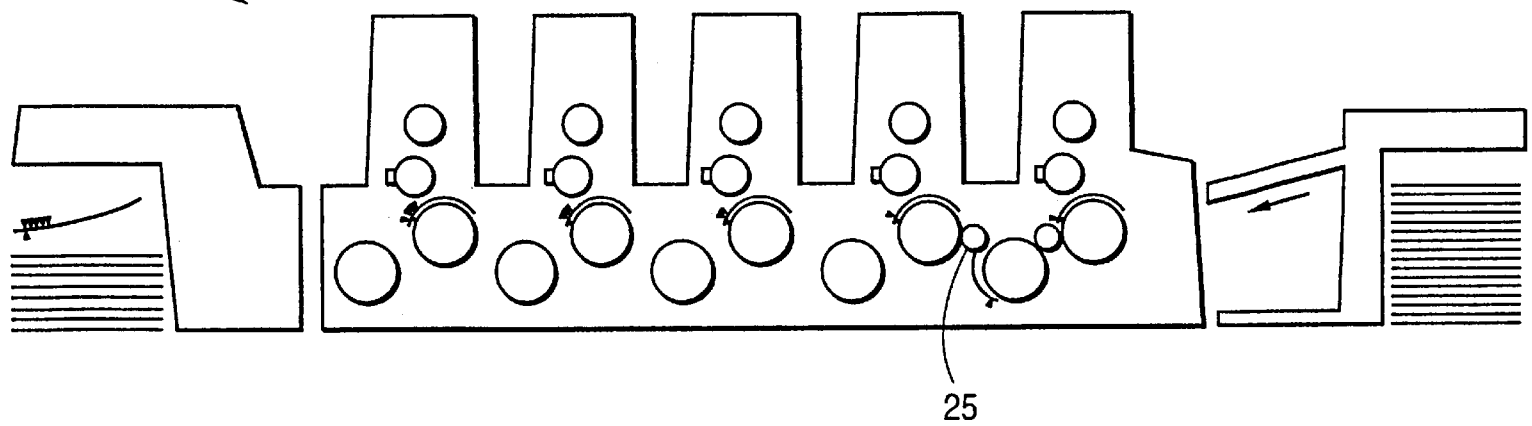

FIGS. 4(A) and (B) show two snapshots of the relevant parts of a sheet fed printing press 20: the upper diagram (FIG. 5(A)) shows how sheets of paper 21 are imprinted in a 5+0 print. The sheets of paper 21 move through a sheet feeder 22 onto the impression cylinder 2, and are each imprinted from the rubber-blanket cylinder 3 that is connected with the printing plate cylinder 4; they are then moved by the transport cylinder 23 to the next impression cylinder 2, until the imprinted sheets of paper 21 are finally deposited in a delivery unit 24. In FIG. 4(B), the sheets of paper 21 are imprinted in a 4+1 print: after the first impression cylinder 2, the sheets of paper 21 pass over a transport cylinder 23 and a sheet-turning drum 25, which means that subsequently, what were formerly the backs of the sheets of paper 21 are imprinted. Accordingly, the same applies here as to the jobbing rotary press: the sequence of the print units in the printing process is essential for the wash sequence programs of the wash devices 9. In addition, in the case of sheet-fed printing presses, it is especially simple to change the paper quality at very short intervals, which has a great influence on the optimal wash sequence programs for the wash devices 9. Naturally, here, too, the other operating parameters such as cylinder speeds, production quantities, quantities of dampening water, smoothness and quantity of ink are essential for compiling the optimal wash sequence programs.

Figure 5:
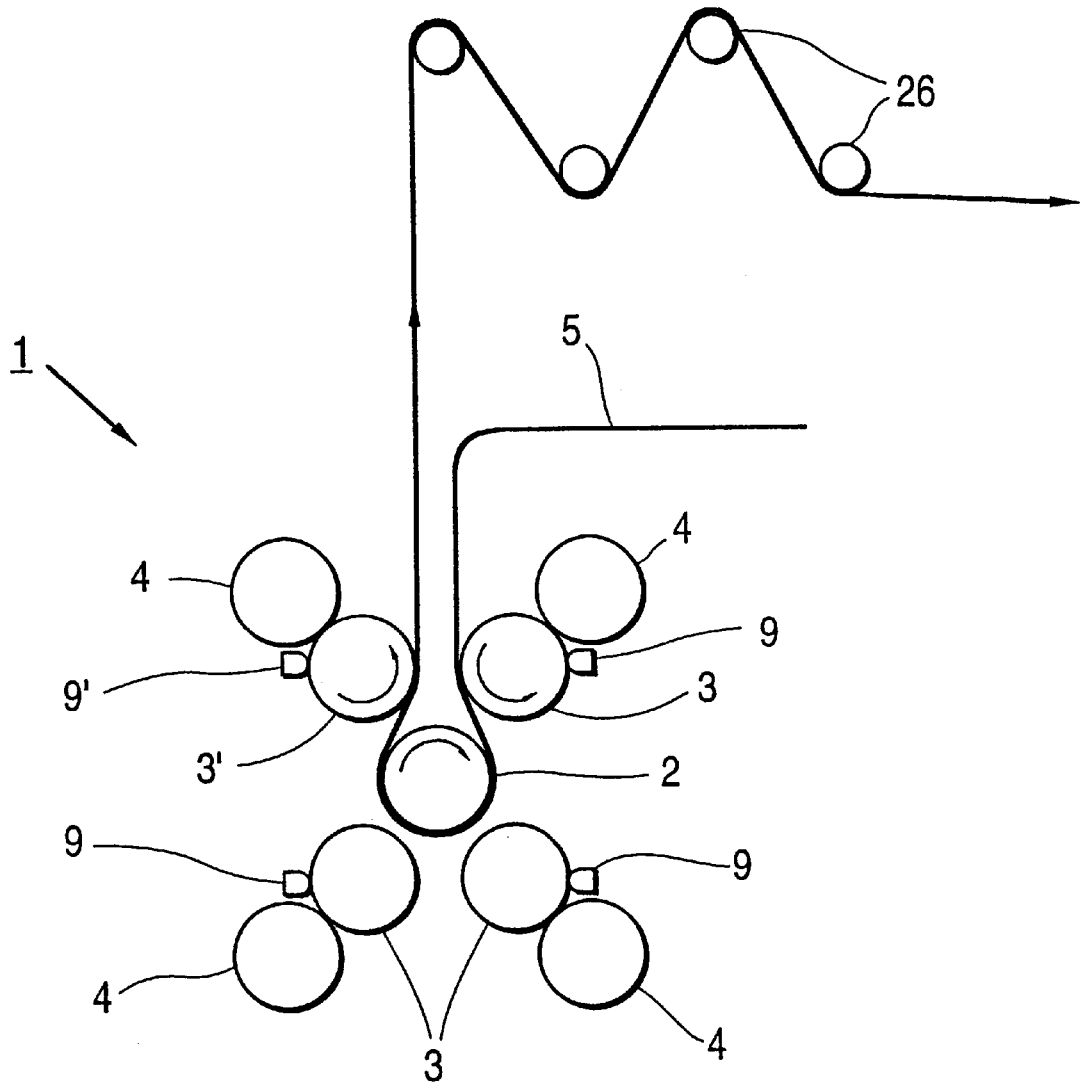
FIG. 5: A schematic drawing of a satellite unit of a newspaper rotary printing press with guide rollers.

FIG. 5 shows the web routing of a newspaper rotary printing press from the last satellite unit 1 to the guide rollers 26 that transport the imprinted paper web 5 for further processing. In this example, the guide rollers 26 are not equipped with automated wash devices 9; neither has the web of material that is to be imprinted been provided with an additional automated wash agent applicator. However, as a result of close contact with the web of paper 5 that is to be imprinted, depending on such operating parameters as run size, type of printing ink, type of paper web, etc., it is necessary to clean the guide rollers 26 from time to time, as well. In the example that is shown this is done by means of the wash device 9' that is mounted on the rubber-blanket cylinder 3'. The rubber-blanket cylinder 3' is the last one with an associated wash device 9' that is in contact with the paper web 5, before this is guided over the guide rollers 26. By accessing the central printing press control system, the guide system expansion according to the present invention recognizes that the rubber-blanket cylinder 3' is the last cylinder with an associated wash device 9' with an appropriate wash sequence program in order to clean the guide rollers 26. The rubber-blanket cylinder 3', and thus indirectly the paper web 5, is dampened with cleaning agent, and these carry the cleaning agent to the guide rollers 26. The guide rollers 26 that are to be cleaned are braked or driven by the passage of the paper web 5, in order to generate slippage. The wiping effect of this slippage between the guide roller 26 on the one hand, and the web of paper 5, moistened with the cleaning agent, on the other, cleans the guide roller 26. Within the framework of the invention, the best wash sequence program with which to ensure optimal results from the washing is selected or identified completely automatically by accessing the data concerning the relevant operating parameters, which is in the central control system. The embodiment of the present invention, which is shown in FIG. 5, is a simple and cost effective, but nevertheless effective variation of the procedure according to the present invention. If need be, and without any additional outlay, wash agent can be applied to both sides of the web of material that is to be imprinted.

Thus, the procedure according to the present invention makes it possible to clean the cylinders of printing presses so as to achieve maximum cleanliness in the shortest possible time, without the risk of tearing in the case of a web-type press, and which makes cleaning possible when the press is running.

Thus, for the first time, the present invention provides for fully automatic cylinder cleaning such that the operator need no longer concern himself with the cleaning process and the optimal time for performing such cleaning.

REFERENCE NUMBERS FOR DRAWINGS

1 Satellite unit

2 Impression cylinder

3 Rubber-blanket cylinder
4 Printing plate cylinder
5 Web of paper
9 Wash device
10–19 Printing units
20 Sheet-fed printing press
21 Sheets of paper
22 Sheet feeder
23 Transport cylinder
24 Sheet delivery unit
25 Sheet-turning drum
26 Guide roller

What is claimed is:

1. A procedure for fully automatic cylinder cleaning in a printing press with a central control system, comprising the steps of:

a) obtaining operating parameters for cylinders of the printing press, from the central control system of the printing press, the operating parameters consisting of parameters effecting the degree of soiling of the cylinders to be cleaned and parameters effecting the result obtained by washing;

b) automatically selecting which cylinders of the printing press should be cleaned based on the operating parameters, by accessing the central control system of the printing press, each selected cylinder having an associated wash device;

c) by accessing the central control system, automatically determining an optimal wash sequence for each selected cylinder based on the operating parameters; and d) by accessing the central control system, automatically controlling the wash devices associated with the selected cylinders based on the optimal wash sequence.

2. A procedure as defined in claim 1, wherein:

the printing press is a web type printing press, for each selected cylinder contacting the material to be imprinted, it is determined which of three classifications describes the angle of wrap of material around the selected cylinder, the three classifications are 0 degrees, greater than 0 degrees and less than or equal to 5 degrees and more than 5 degrees, and one of the three classifications is used as an operating parameter.

3. A procedure as defined in claim 1, further comprising the step of providing a set of wash sequences, each wash sequence of the set being adapted to a different combination of operating parameters, wherein the optimal wash sequence for each selected cylinder is determined by matching the determined operating parameters with a wash sequence of the set of wash sequences, the matching being done by searching for the closest approximation of the determined operating parameters.

4. A procedure as defined in claim 3, characterized in that the wash sequences of the set of wash sequences are checked and corrected manually from the central control system.

5. A procedure as defined in claim 1, wherein the speed of rotation of the selected cylinders is an operating parameter.

6. A procedure as defined in claim 1, wherein the time of a wash process and the time interval since the last wash process are operating parameters.

7. A procedure as defined in claim 1, wherein whether or not there is contact between a material to be imprinted and each selected cylinder during a wash process is an operating parameter.

8. A procedure as defined in claim 7, wherein when there is contact between the material to be imprinted and the selected cylinder, whether a face side or a reversed side of the material is contacting the selected cylinder is an operating parameter.

9. A procedure as defined in claim 1, wherein the type of material to be imprinted is an operating parameter.

10. A procedure as defined in claim 1, wherein ink type is an operating parameter.

11. A procedure as defined in claim 1, wherein the relative position of the selected cylinder with respect to a beginning and an end of a printing process is an operating parameter.

12. A procedure as defined in claim 1, wherein a direction of rotation of the selected cylinder is an operating parameter.

13. A procedure as defined in claim 1, wherein the quantity of dampening water used during printing is an operating parameter.

14. A procedure as defined in claim 1, wherein the printing press is a web-type printing press, and, for each selected cylinder contacting the material to be imprinted, the angle of wrap of the material around the selected cylinder is an operating parameter.

15. A procedure as defined in claim 14, wherein the angle of wrap is determined based on web routing data.

16. A procedure as defined in claim 1, wherein for each selected cylinder, the optimal wash sequence includes a correct time for starting each wash process and the wash devices are controlled in step (d) to start at the correct time or at a next possible time.

17. A procedure as defined in claim 1, wherein at least one of the selected cylinders is a rubber-blanket cylinder, and information as to whether the rubber-blanket cylinder is involved in ink distribution during a printing process is an operating parameter.

18. A procedure as defined in claim 1, wherein, for each selected cylinder which is in contact with material to be imprinted, information as to whether the material has already been imprinted or has not yet been imprinted is an operating parameter.

19. A procedure as defined in claim 1, wherein a quantity of washing agent is controlled in step d).

20. A procedure as defined in any one of the preceding claims, wherein the printing press is a web-type printing press used for imprinting a web of material traveling from a beginning to an end of a printing process, and wherein a guide roller, which is not a selected cylinder, is to be cleaned, further comprising the steps of:

(e) determining which selected cylinder is the first selected cylinder to precede the guide roller to be cleaned, towards the beginning of the printing process;

(f) controlling the wash device associated with the selected cylinder determined in step (e) to dampen the material; and (g) causing slippage between the guide roller to be cleaned and the material by braking or rotationally driving the guide roller.

21. A procedure as defined in claim 20, wherein step (e) determines which selected cylinder precedes the guide roller to be cleaned for each side of the web and wherein step (g) causes braking by manually braking or braking with a device.

22. A procedure for fully automatic cylinder cleaning in a printing press with a central control system, comprising the steps of:

a) obtaining operating parameters for cylinders of the printing press, from the central control system of the printing press, the operating parameters consisting of parameters effecting the degree of soiling of the cylinders to be cleaned and parameters effecting the result obtained by washing;

b) automatically selecting which cylinders of the printing press should be cleaned based on the operating parameters, by accessing the central control system, each selected cylinder having an associated wash device, at least one of the selected cylinders being in contact with a material to be imprinted;

c) by accessing the central control system, automatically determining an optimal wash sequence for each selected cylinder based on the operating parameters; and d) by accessing the central control system, automatically controlling the wash devices associated with the selected cylinders based on the optimal wash sequence.

* * * * *